US006836198B2

(12) United States Patent
Engst

(10) Patent No.: US 6,836,198 B2
(45) Date of Patent: Dec. 28, 2004

(54) ADJUSTABLE CAPACITIVE COUPLING STRUCTURE

(75) Inventor: Bill Engst, Marlboro, NJ (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 10/024,567

(22) Filed: Dec. 21, 2001

(65) Prior Publication Data

US 2003/0117241 A1 Jun. 26, 2003

(51) Int. Cl.[7] ..... H01P 1/20

(52) U.S. Cl. ..... 333/202; 333/231; 333/207; 333/219.1

(58) Field of Search ..... 333/202, 207, 333/209, 219.1, 231, 232, 235

(56) References Cited

U.S. PATENT DOCUMENTS

| | | | | |
|---|---|---|---|---|
| 3,737,816 A | | 6/1973 | Honicke | |
| 4,453,146 A | * | 6/1984 | Fiedziuszko | 333/212 |
| 4,631,506 A | | 12/1986 | Makimoto et al. | |
| 5,126,696 A | | 6/1992 | Grote et al. | |
| 5,389,903 A | | 2/1995 | Piirainen | |
| 5,739,733 A | * | 4/1998 | Cameron | 333/202 |
| 5,781,085 A | | 7/1998 | Harrison | |
| 5,841,330 A | | 11/1998 | Wenzel et al. | |
| 6,025,764 A | | 2/2000 | Pelz et al. | |
| 6,046,586 A | | 4/2000 | Rinard | |
| 6,081,175 A | * | 6/2000 | Duong et al. | 333/212 |
| 6,208,221 B1 | | 3/2001 | Pelz et al. | |
| 6,239,673 B1 | | 5/2001 | Wenzel et al. | |
| 6,255,919 B1 | * | 7/2001 | Smith | 333/202 |
| 6,566,984 B2 | * | 5/2003 | Niiranen et al. | 333/202 |

FOREIGN PATENT DOCUMENTS

| | | |
|---|---|---|
| DE | 196 02 815 A1 | 8/1996 |
| EP | 0 101 369 A1 | 2/1984 |
| EP | 1 258 941 A2 | 11/2002 |

OTHER PUBLICATIONS

Madrangeas et al. "Analysis and Realization of L–Band Dielectric Resonator Microwave Filters," IEEE Transactions on Microwave Theory and Techniques, Jan. 1992, No. 1, pp. 120–127.*

Patent Abstracts of Japan, Publication No. 07015208; Jan. 17, 1995; Yonenaga Kanichi.

* cited by examiner

*Primary Examiner*—Benny Lee
*Assistant Examiner*—Kimberly Glenn

(57) ABSTRACT

A cavity filter which provides for fine tuning of the bandwidth of the filter. The filter provides for both capacitive cross-coupling and inductive coupling between physically adjacent but electrically non-adjacent resonators in the filter. The isolation of the filter can be fine tuned by adjusting the inductive coupling between these resonators, which has the effect of attenuating the cross-coupling effect between these resonators.

17 Claims, 4 Drawing Sheets

ADJUSTABLE CAPACITIVE COUPLING STRUCTURE

BACKGROUND OF THE INVENTION

Field of the Invention

This invention relates to microwave frequency filters. More specifically, this invention relates to a microwave frequency cavity filter whose bandwidth can be precisely fine-tuned with a minimum of effort, expense, and service interruptions.

Discussion of the Related Art

The rapid growth in cellular telephony and wireless communications has created enormous demand for bandwidth in the microwave radio frequency spectrum. As wireless technologies that depend on the microwave spectrum have become more popular, the microwave portion of the radio spectrum has become more crowded. Unused microwave frequencies are occupied by wireless service providers as soon as they become available, forcing wireless communication firms operating in the same location to provide their services on adjacent frequencies, without the benefit of any "empty" bandwidth between them. Because of this congestion, wireless providers need a way to isolate the transmission and reception of their frequencies from neighboring frequencies that are used for other services or by other providers.

To accomplish this frequency isolation, resonator filters have been developed. These filters are built to permit only the frequencies in a certain range to pass through. This frequency range is called the pass band, and the frequencies inside this range are called bandpass frequencies. The frequencies outside of the pass band fall into the stop bands, and are blocked by the filter.

While a number of resonator filter designs have been developed, one of the most common filters for use in microwave communications is the cavity filter. This type of filter consists of a number of resonators placed inside physically adjacent hollow metal cavities, thereby forming cavity resonators. By inductively coupling two or more adjacent resonators, the bandpass frequencies of these resonators are combined, forming a resonator filter with a bandwidth encompassing a range of frequencies.

But in order to properly block the undesired frequencies in the stop band of the filter, some physically adjacent resonators in the filter are capacitively cross-coupled, which effectively cancels out certain frequencies in the filter. Capacitive cross-coupling attenuates the slope of the frequency response curve of the filter between the edge of the pass band and the edge of the stop band, allowing the filter to more precisely match the desired pass band without also erroneously passing frequencies outside of the pass band that may be used for other signals or which may be owned by other service providers. In essence, adjusting the capacitive cross-coupling within the filter fine tunes the isolation of the filter.

In this regard, capacitive cross-coupling and inductive coupling have the opposite effect on the signals passed between adjacent resonators. For this reason, conventional cavity filters do not employ both capacitive cross-coupling and inductive coupling between a given pair of resonators.

In conventional cavity filters, the inductive coupling between adjacent resonators is accomplished by placing a gap in the wall separating the two cavities. The size of the gap determines the amount of coupling. A common method of providing the capacitive cross-coupling in these conventional filters is to extend a metal bar across the wall separating two electrically non-adjacent resonators. The length of the bar determines the capacitive cross-coupling. In order to precisely select the frequency cutoff of the filter between the pass band and the stop band, the cross-coupling bar must have very precise physical dimensions.

Furthermore, in order to fine tune the filter for tolerance purposes, the physical length of the bar must be changed, either by means of a fine tuning screw at one end of the bar, or more commonly by replacing the bar with another one of different length.

But adjustment of the capacitive cross-coupling by either means is cumbersome and impractical. First, conventional cavity filters used for microwave signals are quite large and are made entirely of metal with covers or lids made of lead that cover the resonator cavities as well as the cross-coupling bars. Replacing or adjusting the cross-coupling bar requires physically removing this lead cover, which is difficult and labor intensive.

Furthermore, manufacturing the cross-coupling bars to the precise physical dimensions and tolerances required in conventional filters makes them expensive, which adds further to the overall cost of the filter.

Given these problems with conventional filters as well as the increased need for precise tuning of filter bandwidth at low cost, what is needed is a cavity filter that can be manufactured at a reduced cost but whose bandwidth can be very precisely tuned and adjusted with a minimum of effort and without interruption of service.

SUMMARY OF THE INVENTION

The invention is directed to a cavity filter. According to a first aspect of the invention, the resonator comprises a filter housing having at least two cavities separated by a cavity wall; a filter cover for covering said filter housing; and a plurality of resonators respectively disposed in said cavities, wherein at least two of the resonators are coupled to each other by both an inductive coupler and a capacitive cross-coupler.

Specifically, the capacitive cross-coupler includes a bar that extends from the cavity wall into each of the cavities and the inductive coupler is an opening in the cavity wall between the cavities. The inductive coupler also includes an adjustable fine tuner comprising a screw threaded through either the filter cover or the filter housing, such that the screw extends into the opening in the cavity wall.

The invention is also directed to a method of fine tuning the slope of the frequency response curve of the cavity filter described above by attenuating the capacitive cross-coupling effect indirectly by adjusting the fine tuner of the inductive coupler. Specifically, the fine tuner is adjusted from the exterior of the filter by turning the screw further into the opening in the cavity wall, thereby increasing the inductance of the inductive coupler, reducing the capacitance between the two resonators. Similarly, by unscrewing the screw, it is retracted from the opening, reducing the inductance of the coupler and increasing the capacitance between the two resonators.

BRIEF DESCRIPTION OF THE DRAWINGS

The objects and advantages of the present invention will be made more clear with reference to the following drawings, in which like elements have been given like reference characters. In particular.

DETAILED DESCRIPTION OF THE PREFERRED EMBODIMENTS

Figure 1:
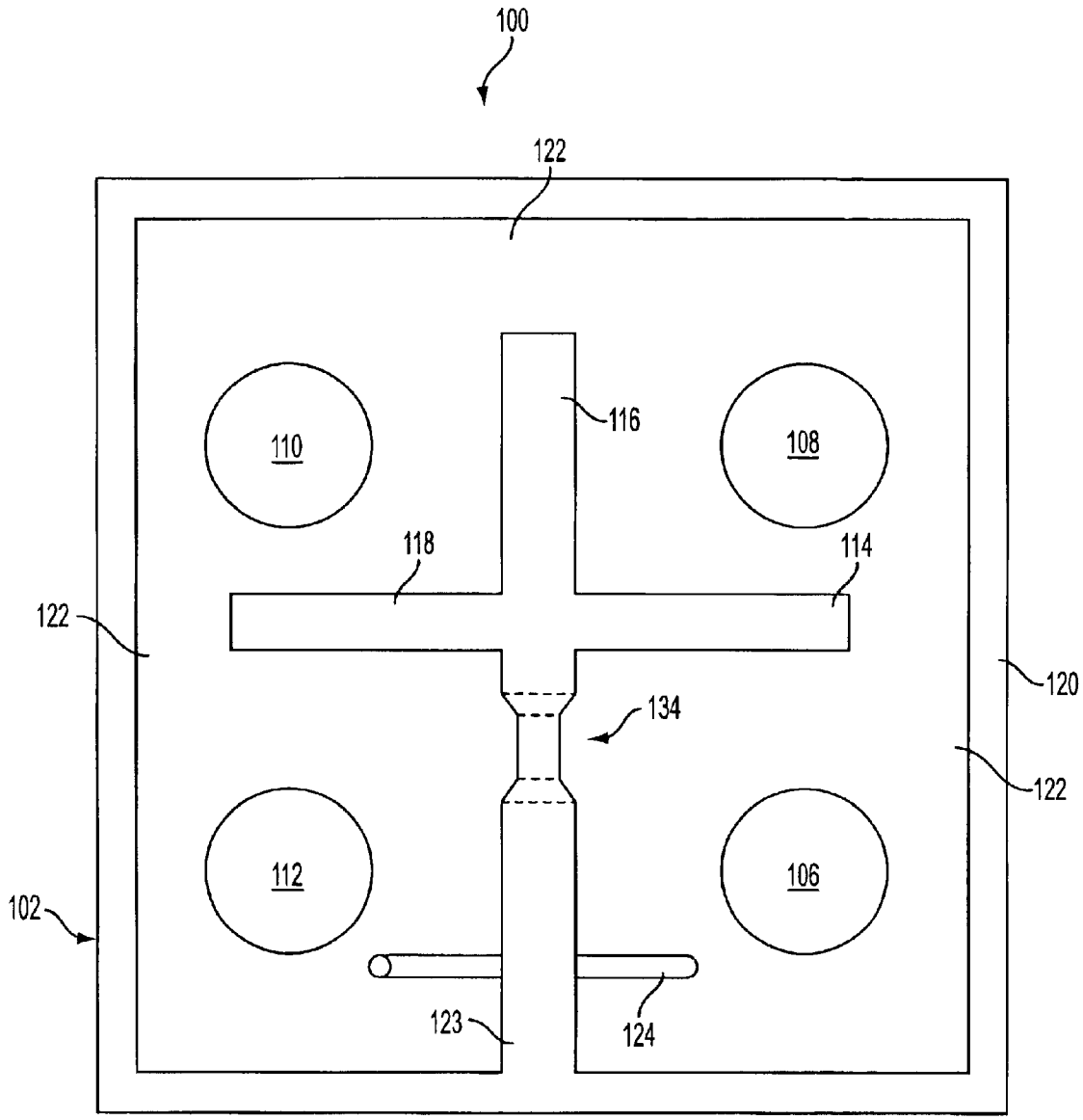
FIG. 1 is a top view of a cavity filter of the present invention.
Figure 2:
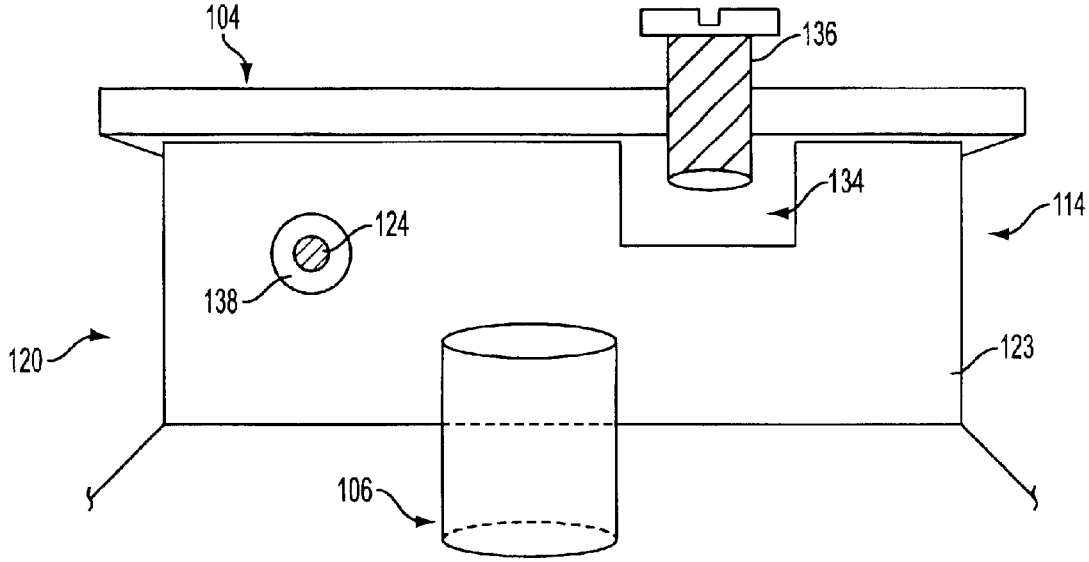
FIG. 2 is a front view of a cavity wall of the cavity filter of the present invention which includes both capacitive cross-coupler and inductive coupler between the electrically non-adjacent resonators of FIG. 1.

The preferred embodiment of the invention is described with reference to FIGS. 1 and 2, showing a four-cavity filter 100. According to a preferred embodiment, the resonator filter 100 includes a filter housing 102 and a filter cover 104. Provided in the housing 102 are a plurality of resonators 106, 108, 110, and 112. The resonators are inductively coupled in series such that resonator 106 is coupled to resonator 108, resonator 108 is coupled to resonator 110, and resonator 10 is coupled to resonator 112. These resonators are separated from each other by cavity walls 114, 116, 118, and 123 that form a cross-shaped arrangement. As shown in FIG. 1, walls 114, 116, and 118 extend only partially to the perimeter walls 120 of the filter housing 102 leaving a gap 122 therebetween. Hence, the walls permit inductive coupling between resonators 106–108; 108–110; and 110–112.

On the other hand, it is preferable that cavity wall 123 extends all the way to the perimeter wall 120. This cavity wall 123 electrically separates the first resonator 106 in the series from the last resonator 112 in the series. Hence resonators 106 and 112 are not inductively coupled in the way that the other resonators are, and are therefore are not electrically adjacent in the series despite being physically adjacent.

Figure 3:
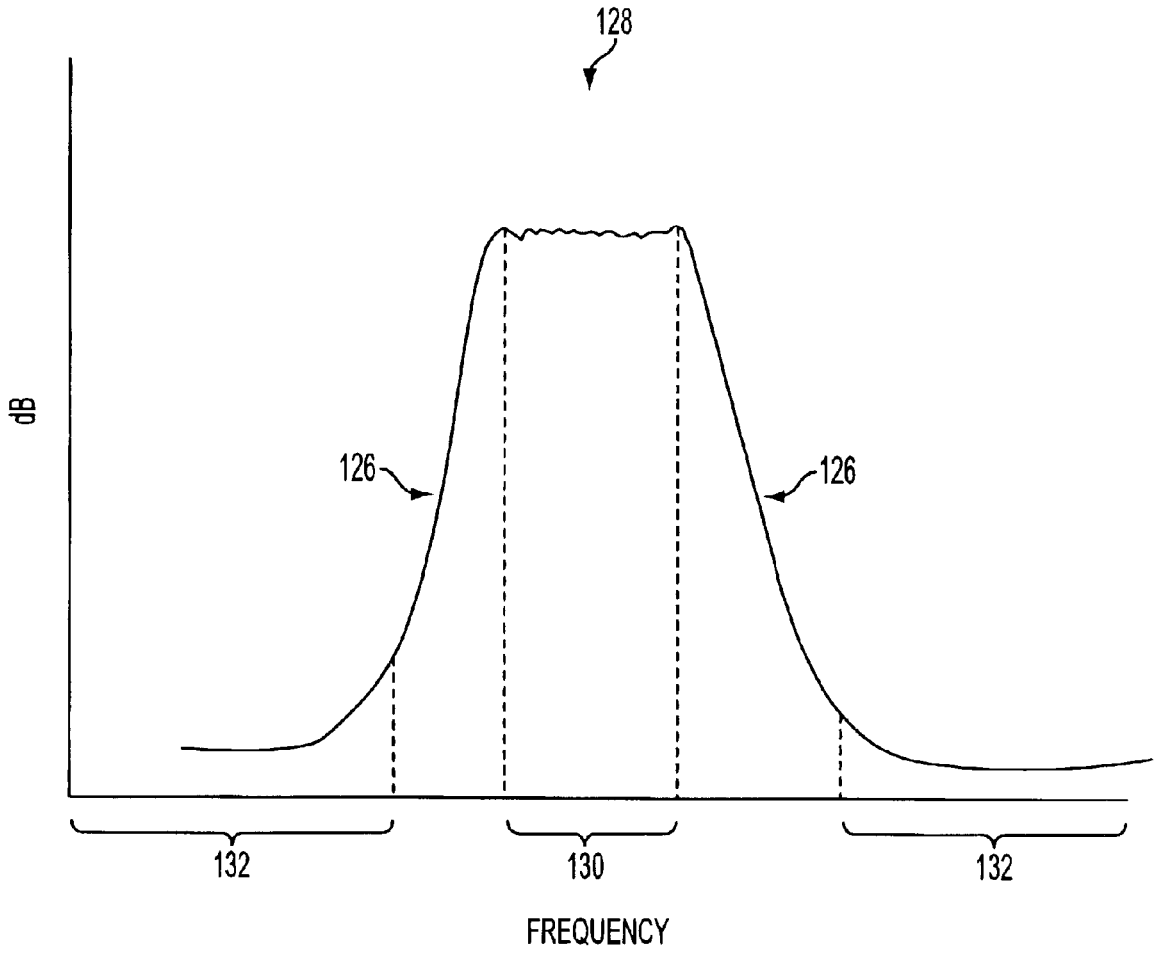
FIG. 3 is a sample frequency response curve of a cavity filter of the present invention.

Because they are physically adjacent, resonators 106 and 112 can be capacitively cross-coupled using the cross-coupling bar 124. Referring to FIG. 3, the purpose of the cross-coupling bar 124 is to attenuate the slope 126 of the cutoff in the frequency response curve 128 between the pass band 130 and the stop bands 132 in FIG. 3. In order to fine tune this capacitive cross-coupling effect, the invention includes an inductive coupler in cavity wall 123 in the form of a notch 134 provided in cavity wall 123 and an associated fine tuning screw 136, shown in FIG. 2. The fine tuning screw 136 extends through the filter cover 104 into the notch 134. The capacitance cross-coupling effect can be changed by turning the screw from the exterior of the filter 100. More specifically, when the screw is turned so that it extends further into the notch 134 the inductance provided by the notch is raised thereby reducing the effective length of the cross-coupling bar 124 and, attendantly, the capacitive cross-coupling between resonators 106 and 112.

Conversely, when the screw is turned in the opposite direction (i.e., to shorten the distance that the fine tuning screw 136 extends into the notch 134), the inductance provided by the notch is reduced thereby increasing the effective length of the cross-coupling bar 124, and, attendantly, the capacitive cross-coupling between resonators 106 and 112.

Referring to FIG. 2, the filter cover 104 encloses the resonator cavity. According to the preferred embodiment, the filter cover 104 is made of lead, while the housing 102 is made of iron. Of course, the invention is not limited in this respect. The cross-coupling bar 124 is held in the cavity wall 123 by a collar 138, made of an electrically insulating material such as plastic. As noted above, the tuning screw 1136 extends through the filter cover 104 into the notch 134. While notch 134 can be of any height equal to or less than the height of wall 123, in the preferred embodiment the notch provides only fine adjustment of the capacitive effect of the cross-coupling bar 124. Therefore, the height of the notch is only between twenty and fifty percent of the height of the wall 123. Again, however, it should be understood that the invention is not limited to any particular height.

Figure 4:
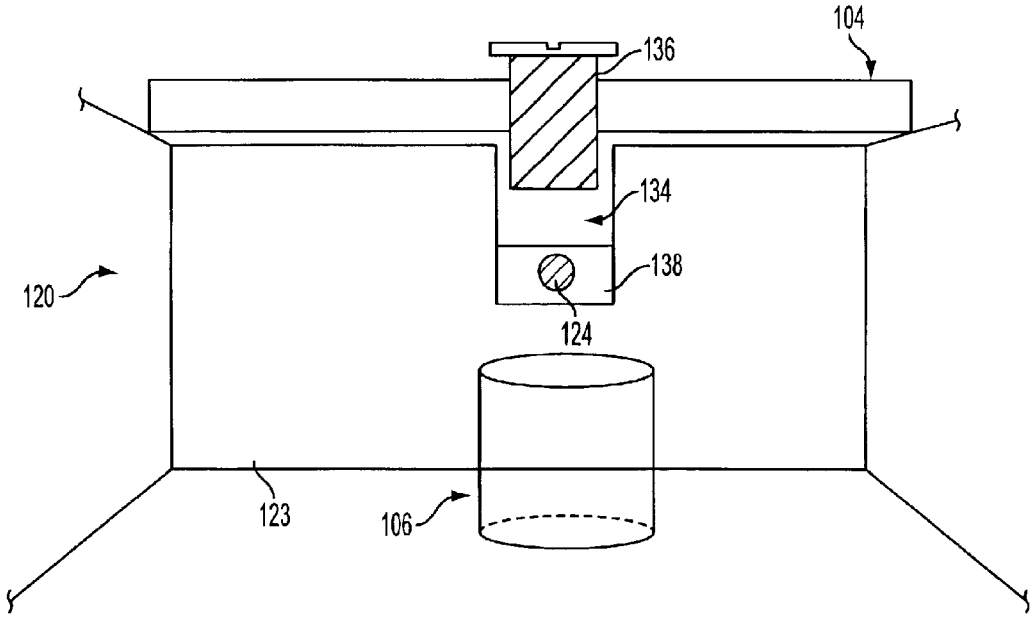
FIG. 4 is a front view of another alternate embodiment of the present invention showing the same cavity wall as FIG. 2 but with a different inductive coupler.

FIG. 4 illustrates additional embodiment of the invention. In particular, in the embodiment of FIG. 4, both the bar 124 and the notch 134 are set in the middle of cavity wall 123. The tuning notch 134 is provided above the bar 124. This embodiment shows a filter which can be easily changed from one capacitive cross-coupling level to another by easily replacing the bar, but which also retains the ability to fine tune the bar 124 once it is set in place by adjusting the tuning screw 136 that extends through the top of the filter cover 104. More specifically, with this arrangement, the insulating collar 138 that holds the bar 124 in place can be easily removed by sliding it out through the slot 134.

Having described the invention with particular reference to the preferred embodiments, it will be obvious to those skilled in the art to which the invention pertains after understanding the invention, that various modification s and changes may be made therein without departing from the spirit and scope of the invention as defined by the claims appended hereto.

What is claimed:

1. A cavity filter comprising:

a filter housing, said housing having at least first and second cavities separated by a cavity wall, said cavity wall running the entire length of the first and second cavities;

a filter cover for covering said filter housing; and a plurality of resonators respectively disposed in said cavities, wherein first and second resonators, of said plurality of resonators, are coupled to each other by both an adjustable inductive coupler and a capacitive cross-coupler.

2. The cavity filter of claim 1 wherein said cavity wall has an opening therein such that said first and second cavities can communicate with each other, said opening corresponding to said inductive coupler.

3. The cavity filter of claim 2 wherein said capacitive cross-coupler includes a bar that extends from said cavity wall into each of said first and second cavities.

4. The cavity filter of claim 3 further comprising a tuner for adjusting the inductance of the inductive coupler.

5. The cavity filter of claim 4 wherein the tuner includes an electrical conductor that extends into the opening of said cavity wall.

6. The cavity filter of claim 5 wherein the extent that said electrical conductor extends into the opening is adjustable.

7. The cavity filter of claim 6 wherein the electrical conductor is a screw threadedly engaged in the filter cover.

8. The cavity filter of claim 6 wherein the electrical conductor is a screw threadedly engaged in the filter housing.

9. The cavity filter of claim 1, wherein said inductive coupler and said capacitive cross-coupler are disposed adjacent each other.

10. The cavity filter of claim 9, wherein said inductive coupler includes a notch and conductive member that extends into said notch, and wherein said capacitive cross-coupler includes a bar that extends from said cavity wall into each of said first and second cavities.

11. The cavity filter of claim 10, wherein said bar is provided in an insulating collar which is removably fixed to said cavity wall.

12. The cavity filter of claim 1, further comprising third and fourth resonators respectively provided in third and fourth cavities, said third and fourth resonators being adjacent each other and inductively coupled to each other.

13. A method of tuning the frequency response of the bandwidth of a cavity filter that includes a filter housing, a filter cover for covering said filter housing, a plurality of resonators respectively disposed in cavities, including a first and second resonator respectively disposed in first and second cavities, a cavity wall running the entire length of the first and second cavities and disposed between said first and second resonators, an inductive coupler that includes a tuner, and a capacitive cross-coupler; said method comprising;

adjusting the cross-coupling effect between said first and second resonators by adjusting the inductive coupler.

14. The method of tuning the frequency response of the bandwidth of a cavity filter of claim 13, wherein the step of adjusting the inductive coupler comprises tuning the tuner accessible from the exterior of the cavity filter.

15. The method of tuning the frequency response of the bandwidth of a cavity filter of claim 14, wherein the step of adjusting the tuner comprises altering the position of a screw engaged in the filter cover.

16. The method of fine tuning the frequency response of the bandwidth of a cavity filter of claim 14, wherein the step of adjusting the fine tuner comprises turning a screw threadedly engaged in the filter housing.

17. A method of tuning the frequency response of the bandwidth of a cavity filter that includes a filter housing with a plurality of resonators disposed in cavities, a first and second of said plurality of resonators separated by a cavity wall running the entire length of the first and second cavities, comprising the step of adjusting the capacitive cross-coupling effect between said resonators by externally adjusting the inductive coupling.

* * * * *